United States Patent [19]

Knabel et al.

[11] Patent Number: 4,477,102

[45] Date of Patent: Oct. 16, 1984

[54] CROSS COUNTRY SKI BINDING

[75] Inventors: Walter Knabel, Farchant; Werner Messerschmidt, Garmisch-Partenkirchen, both of Fed. Rep. of Germany

[73] Assignee: Marker-Patentverwertungsgesellschaft, Baar, Switzerland

[21] Appl. No.: 339,435

[22] PCT Filed: May 8, 1981

[86] PCT No.: PCT/EP81/00045

§ 371 Date: Jan. 7, 1982

§ 102(e) Date: Jan. 7, 1982

[87] PCT Pub. No.: WO81/03127

PCT Pub. Date: Nov. 12, 1981

[30] Foreign Application Priority Data

May 9, 1980 [DE] Fed. Rep. of Germany ..... 3017866

[51] Int. Cl.[3] ..... A63C 9/18

[52] U.S. Cl. ..... 280/615

[58] Field of Search ..... 280/614, 615, 605, 635

[56] References Cited

U.S. PATENT DOCUMENTS

| | | | |
|---|---|---|---|
| 1,702,330 | 2/1929 | With | 280/615 |
| 1,868,386 | 7/1932 | Gresvig | 280/615 |
| 2,450,514 | 8/1948 | Humlegard | 280/615 |
| 2,469,478 | 5/1949 | Ruud | 280/615 |
| 3,861,700 | 1/1975 | Fredriksen | 280/615 |
| 4,093,269 | 6/1978 | Hoffman | 280/615 |

FOREIGN PATENT DOCUMENTS

| | | | |
|---|---|---|---|
| 2436117 | 2/1976 | Fed. Rep. of Germany | 280/605 |
| 75529 | 12/1944 | Norway | 280/615 |
| 118138 | 12/1947 | Switzerland | 280/615 |

*Primary Examiner*—David M. Mitchell

[57] ABSTRACT

A cross country ski binding is provided with a tensioning yoke for engaging over the front upper edge of the boot sole to secure the toe of the boot against lifting off a base plate which is to be fixed to the sole and is provided with upright prongs for engaging in appropriate holes in the underface of the sole of the boot. The tensioning yoke is mounted in side flanges of the base plate and secured in the closed position by a spring-biassed locking lever. In order that the tensioning lever is in its readiness position in the unsecured condition and after release by the locking lever, it is subjected to the force of a retaining spring which seeks to hold it in the open position.

9 Claims, 2 Drawing Figures

CROSS COUNTRY SKI BINDING

The invention relates to langlauf (cross-country) ski bindings according to the classifying portion of the main claim.

Such cross country ski bindings are marketed in a multiplicity of forms. Before inserting the boot, their tensioning yoke has to be positioned so that the toe of the boot can be brought over the prongs and then lowered. Thereafter, the tensioning yoke can be swung down, usually with the aid of a ski stick, and automatically latched by the locking lever. What is cumbersome is the manipulation of the tensioning yoke to bring it to its readiness position. In most cases, it is necessary for the skier to stoop and handle the tensioning yoke directly.

Conversely, it is necessary with these bindings that, for unlatching the locking lever to release the tensioning yoke, which is normally likewise done with the aid of a ski pole, the boot be raised at the same time to bring the tensioning yoke out of the effective range of the locking lever.

The present invention aims to improve and construct a cross country ski binding of the aforementioned kind so that the tensioning yoke, when not secured in position by the locking lever, will assume such a predetermined erect position that it does not have to be specially manipulated either for introducing the toe of the boot in the binding or for bringing the tensioning yoke into its closed position with the aid of a ski pole. Conversely, the tensioning yoke should, after release by the locking lever, automatically return to its readiness position.

Accordingly, based on a cross country ski binding comprising a tensioning yoke for engaging over the front upper edge of the boot sole to secure the toe of the boot against lifting off a base plate which is to be fixed to the ski and is provided with upright prongs for engaging in appropriate holes in the underface of the sole of the boot, the tensioning yoke being mounted in side flanges of the base plate and being secured in the closed position by a spring-biassed locking lever, this is achieved according to the invention in that the tensioning yoke is under the influence of a spring force which seeks to hold it in the open position.

In a constructional embodiment of the invention, the tensioning yoke, which is pivoted in known manner to the side flanges, can be subjected to a spring force.

In most cases, the tensioning yoke is formed from a piece of wire bent into substantially U shape. According to the present invention, at least one of the arms of the tensioning yoke that is pivotably mounted in the side flanges can in that case co-operate with a run-up cam at the associated side flange for elastically deforming the arm during pivoting to the closed position. In a particular form of this constructional variation, the run-up cam may be formed on a bearing bushing inserted in the side flange.

If both arms of the tensioning yoke co-operate with a respective run-up cam, it has proved desirable for each run-up cam to be extended by a second cam branch to form a latching catch. In particular, this offers a manufacturing advantage because it makes it unnecessary to provide different run-up cam members for the side flanges.

In a particular form of the invention, at least one arm of the tensioning yoke can be fixed in the associated side flange against rotation so that, starting with the open position, the arm is elastically deformed during swinging to the closed position.

An example of the invention will hereinafter be described in more detail with reference to the accompanying drawing, in which.

Figure 2:
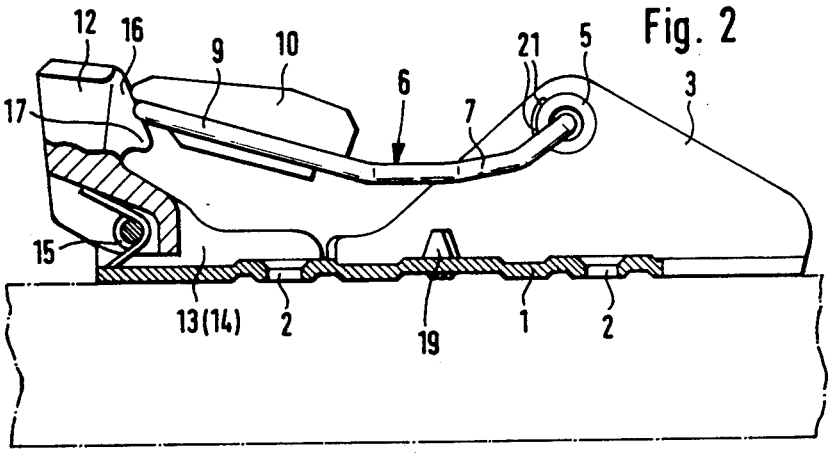
FIG. 2 is a section on line II—II in FIG. 1.
Figure 1:
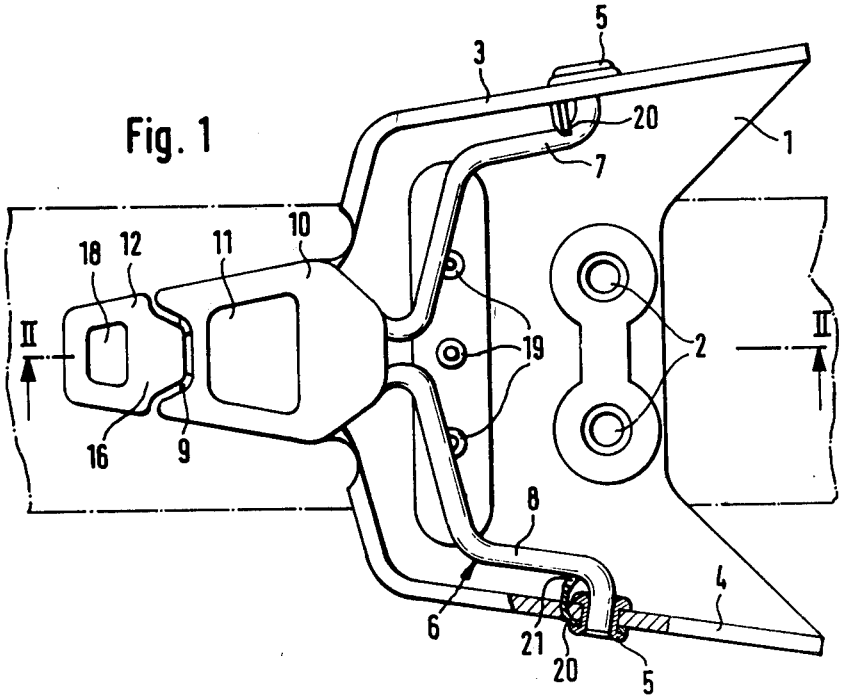
FIG. 1 is a plan view of the cross country ski binding.

The cross country ski binding comprises a base plate 1 with screw holes 2 for screwing onto a ski shown in chain-dotted lines. A bearing bushing 5 is provided in each of side flanges 3, 4 extending from the base plate. The outwardly flanged free ends of arms 7, 8 of a tensioning yoke 6 engage in the bearing bushings. The tensioning yoke comprises a piece of bent wire having a web or crosspiece which is formed with a central eye 9 and which further comprises an actuating button 10 inserted in the eye. A recess 11 in this button serves to receive the tip of a ski pole for closing the tensioning yoke. The free end of the eye is intended to co-operate with a locking lever 12 which is mounted in bent-up lugs 13, 14 of the base plate in front of the tensioning yoke and which is subjected to the influence of a coiled bending spring 15 holding it in its locked position. To achieve two locking possibilities for the tensioning yoke for adapting to different sole thicknesses, the locking lever has two projections 16, 17. In order that it may likewise be operated by a ski pole, it also has a recess 18 for inserting the tip of the ski pole. Finally, the base plate 1 is provided with three upright prongs 19 serving to engage in corresponding holes in the underface of the boot sole.

A cam member 20 is inserted in each side flange 3, 4 adjacent to the bearing bushings 5 and held in position by a rivet head of the bushing. Each cam member comprises a run-up cam 21 over which a respective arm 7 or 8 of the tensioning yoke 6 glides when the tensioning yoke is swung to the closed position. The two arms of the tensioning yoke are thereby flexed towards each other so that the tensioning yoke seeks to assume its open or readiness position in the unlocked condition.

To simplify assembly of the cross country ski binding, the same cam member 20 is used for co-operating with the arm 7 of the tensioning yoke as is designed to co-operate with the arm 8. For this purpose, the run-up cam 21 has two symmetrical cam branches extending from a central low point. As viewed in the drawing, it is only each lower cam branch that is required for the function according to the invention. However, the presence of each upper cam branch is also of advantage in that it limits upward pivoting of the tensioning yoke 6. It is thus not possible for the tensioning yoke to turn over so far towards the boot that it cannot, or can no longer be readily, operated directly by the ski pole.

The Figures show the tensioning yoke in its closed position. In this position, the prongs engage in the boot sole from beneath and the tensioning yoke secures the sole against unintentional release from the prongs. If the locking lever 12 is swung counterclockwise in FIG. 2, for example by inserting the tip of the ski pole, the projection 16 releases the tensioning yoke 6 and the latter automatically swings to its open position in that the arms 7, 8 unflex by moving along the the cams 21.

We claim:

1. A cross country ski binding comprising:

a base plate attachable to a ski, said base plate having forward and rearward end portions, and laterally spaced, upwardly extending side flanges, with generally aligned receptacles in the respective flanges;

a tensioning yoke having lateral end portions pivotally mounted in the respective receptacles, a forwardly disposed crosspiece intermediate said lateral end portions and arms extending between the respective lateral end portions and said crosspiece within the confines of said flanges, said arms being movable between a downward closed position for engaging the sole of a ski boot and an upward releasing position, and said arms being biassed outwardly towards the respective flanges;

cam means engageable by said arms for urging said arms toward the upward releasing position; and locking means for releasably engaging said crosspiece and locking said arms in the downward closed position.

2. The invention according to claim 1 wherein said locking means comprises a locking lever having projection means for locking engagement with said crosspiece and being pivotally mounted in the forward end portion of said base plate for movement between a locking position in the path of said crosspiece and a releasing position out of the path of said crosspiece, and spring means for biassing said locking means towards the locking position.

3. The invention according to claim 1 wherein said receptacles comprise bushings in the respective flanges having bases dimensioned to receive the respective flanges having tensioning yoke, and said cam means comprise cam portions extending from said bushings.

4. The invention according to claim 3 wherein said cam portions extend from positions outside of said flanges through openings in the side flanges.

5. A cross country ski binding comprising:

a base plate attachable to a ski, said base plate having forward and rearward end portions, and laterally spaced, upwardly extending side flanges, with generally aligned receptacles in the respective flanges;

a tensioning yoke having lateral end portions pivotally mounted in the respective receptacles, a forwardly disposed crosspiece intermediate said lateral end portions and arms extending between the respective lateral end portions and said crosspiece within the confines of said flanges, said arms being movable between a downward closed position for engaging the sole of a ski boot and an upward releasing position, and said arms being biassed outwardly towards the respective flanges;

a pair of cam members disposed on the respective flanges, and having upwardly and outwardly tapered surfaces for urging said arms toward the upward releasing position; and locking means for releasably engaging said crosspiece and locking said arms in the downward closed position.

6. The invention according to claim 5 wherein said locking means comprises a locking lever having projection means for locking engagement with said crosspiece and being pivotally mounted in the forward end portion of said base plate for movement between a locking position in the path of said crosspiece and a releasing position out of the path of said crosspiece, and spring means for biassing said locking means towards the locking position.

7. The invention according to claim 5 wherein said receptacles comprise bushings in the respective flanges having bases dimensioned to receive the respective end portions of said tensioning yoke, and said cam members comprise cam portions extending from said bushings.

8. The invention according to claim 7 wherein said cam portions extend from positions outside of said flanges through openings in the side flanges.

9. The invention according to claim 5 wherein said cam members further comprise upper cam branches defining abutment surfaces in the upper path of movement of said arms for limiting the upward movement of said arms.

* * * * *